US008826919B2

(12) United States Patent
Dinh

(10) Patent No.: US 8,826,919 B2
(45) Date of Patent: Sep. 9, 2014

(54) METHOD FOR GROUPING EYELASHES AND APPLYING EYELASH EXTENSIONS

(76) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 13/399,999

(22) Filed: Feb. 17, 2012

(65) Prior Publication Data

US 2013/0213427 A1 Aug. 22, 2013

(51) Int. Cl.

| | |
|---|---|
| ***A41G 3/00*** | (2006.01) |
| ***A41G 5/00*** | (2006.01) |
| ***A45D 40/30*** | (2006.01) |
| ***A41G 5/02*** | (2006.01) |

(52) U.S. Cl.

CPC ..... *A41G 5/02* (2013.01)
USPC ..... 132/201; 132/216; 132/53

(58) Field of Classification Search

CPC ..... A41G 3/0075; A41G 3/00; A41G 5/004; A41G 5/02
USPC ..... 132/201, 53–56, 216, 217, 218, 207, 132/333, 212, 200; 446/393, 394; 119/600, 119/601, 607

See application file for complete search history.

(56) References Cited

U.S. PATENT DOCUMENTS

| | | | | |
|---|---|---|---|---|
| 1,831,801 | A | | 9/1931 | Birk |
| 1,897,719 | A | | 2/1933 | Birk |
| 3,516,422 | A | | 6/1970 | Bechtold et al. |
| 3,561,458 | A | | 2/1971 | Udes |
| 3,566,889 | A | | 3/1971 | Cole et al. |
| 3,833,007 | A | | 9/1974 | Jacobs |
| 3,880,175 | A | | 4/1975 | Hosokawa |
| 3,900,038 | A | | 8/1975 | Masters |
| 3,968,807 | A | | 7/1976 | Kraicer |
| 4,029,111 | A | | 6/1977 | Barton |
| 4,299,242 | A | | 11/1981 | Choe |
| D278,086 | S | | 3/1985 | Greenberg |
| 4,934,387 | A | * | 6/1990 | Megna ..... 132/201 |
| 5,231,999 | A | * | 8/1993 | Schroettner ..... 132/137 |
| 5,547,529 | A | | 8/1996 | Woolf |
| 6,536,445 | B2 | | 3/2003 | Kuroda |
| D510,159 | S | | 9/2005 | Song |
| 7,600,519 | B2 | | 10/2009 | Dinh |
| D632,018 | S | | 2/2011 | Nguyen |
| D632,019 | S | | 2/2011 | Nguyen |
| 8,113,218 | B2 | | 2/2012 | Nguyen |
| 8,127,774 | B2 | | 3/2012 | Dinh |
| 2003/0005941 | A1 | | 1/2003 | Iosilevich |
| 2005/0061341 | A1 | | 3/2005 | Choe |
| 2007/0023062 | A1 | | 2/2007 | McKinstry et al. |

(Continued)

OTHER PUBLICATIONS http://www.youtube.com/watch?v=Z9zRCFkyWil (Jul. 28, 2011).*

(Continued)

*Primary Examiner* — Vanitha Elgart
(74) *Attorney, Agent, or Firm* — Tope-McKay & Associates

(57) ABSTRACT

Described is a method for grouping eyelashes and applying eyelash extensions based on the eyelash groupings. The method includes an act of forming an eyelash group, the eyelash group including a plurality of actual eyelashes that are adhered together to form the eyelash group. An eyelash is separated from the eyelash group using tweezers or another similar item. Thereafter, an eyelash extension is adhered to the eyelash that is separated from the eyelash group, thereby providing a user with an eyelash group and an eyelash extension applied to an actual eyelash. The process can be repeated for any desired amount of remaining ungrouped eyelashes.

5 Claims, 17 Drawing Sheets

(56) References Cited

U.S. PATENT DOCUMENTS

| | | | | |
|---|---|---|---|---|
| 2007/0272264 | A1 | 11/2007 | Byrne | |
| 2007/0295353 | A1 | 12/2007 | Dinh | |
| 2008/0196732 | A1 | 8/2008 | Merszei | |
| 2009/0020133 | A1* | 1/2009 | Gueret | 132/201 |
| 2009/0217938 | A1 | 9/2009 | Rabe et al. | |
| 2010/0000563 | A1* | 1/2010 | Dinh | 132/201 |
| 2011/0253156 | A1* | 10/2011 | Harley et al. | 132/200 |
| 2012/0055499 | A1* | 3/2012 | Sanbonmatsu | 132/201 |
| 2012/0145173 | A1* | 6/2012 | Dinh | 132/200 |

OTHER PUBLICATIONS http://www.catandco.com.au/About-Lashtopia-Eyelash-Extensions-18.html (2012).*

* cited by examiner

METHOD FOR GROUPING EYELASHES AND APPLYING EYELASH EXTENSIONS

BACKGROUND OF THE INVENTION (1) Field of Invention

The present invention relates to eyelashes and, more particularly, to a method for grouping eyelashes and applying eyelash extensions based on the eyelash groupings.

(2) Description of Related Art

Beauty products have tong been known in the art. Users, women in particular, have sought a variety of beauty products to enhance their aesthetic appearance. For example, blush is often used to add color to a woman's cheeks. As another example, lipstick is traditionally used to add a variety of colors and features to a user's lips.

To enhance the appearance of a user's eyelashes, the user often applies mascara. Mascara is applied to the user's eyelashes to both thicken (provide volume) and bring color to the eyelashes. A problem with mascara is that it can form globs or globules of mascara and, in some cases, run from the eyelashes to mark the wearer's face.

As an alternative to mascara, a user can apply adhesive-backed false eyelashes. The adhesive-backed false eyelashes typically consist of a tape-like material with a plurality of eyelashes affixed thereto. The tape-like material can be applied to the user's eyelid to add the appearance of thick and full eyelashes.

A problem with adhesive-backed false eyelashes is that they typically do not look natural and because of their bulk, cannot be worn comfortably for extended periods of time.

Thus, a continuing need exists for a method for providing volume to a wearer's eyelashes without the use of mascara.

SUMMARY OF INVENTION

The present invention relates to a method for grouping eyelashes and applying eyelash extensions based on the eyelash groupings. The method includes an act of forming an eyelash group, the eyelash group including a plurality of actual eyelashes that are adhered together to form the eyelash group. An eyelash is separated from the eyelash group using tweezers or another similar item. Thereafter, an eyelash extension is adhered to the eyelash that is separated from the eyelash group, thereby providing a user with an eyelash group and an eyelash extension applied to an actual eyelash. The process can be repeated for any desired amount of remaining ungrouped eyelashes. Through the present invention, the user is provided with full eyelashes with increased volume through the group and application of eyelash extensions.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
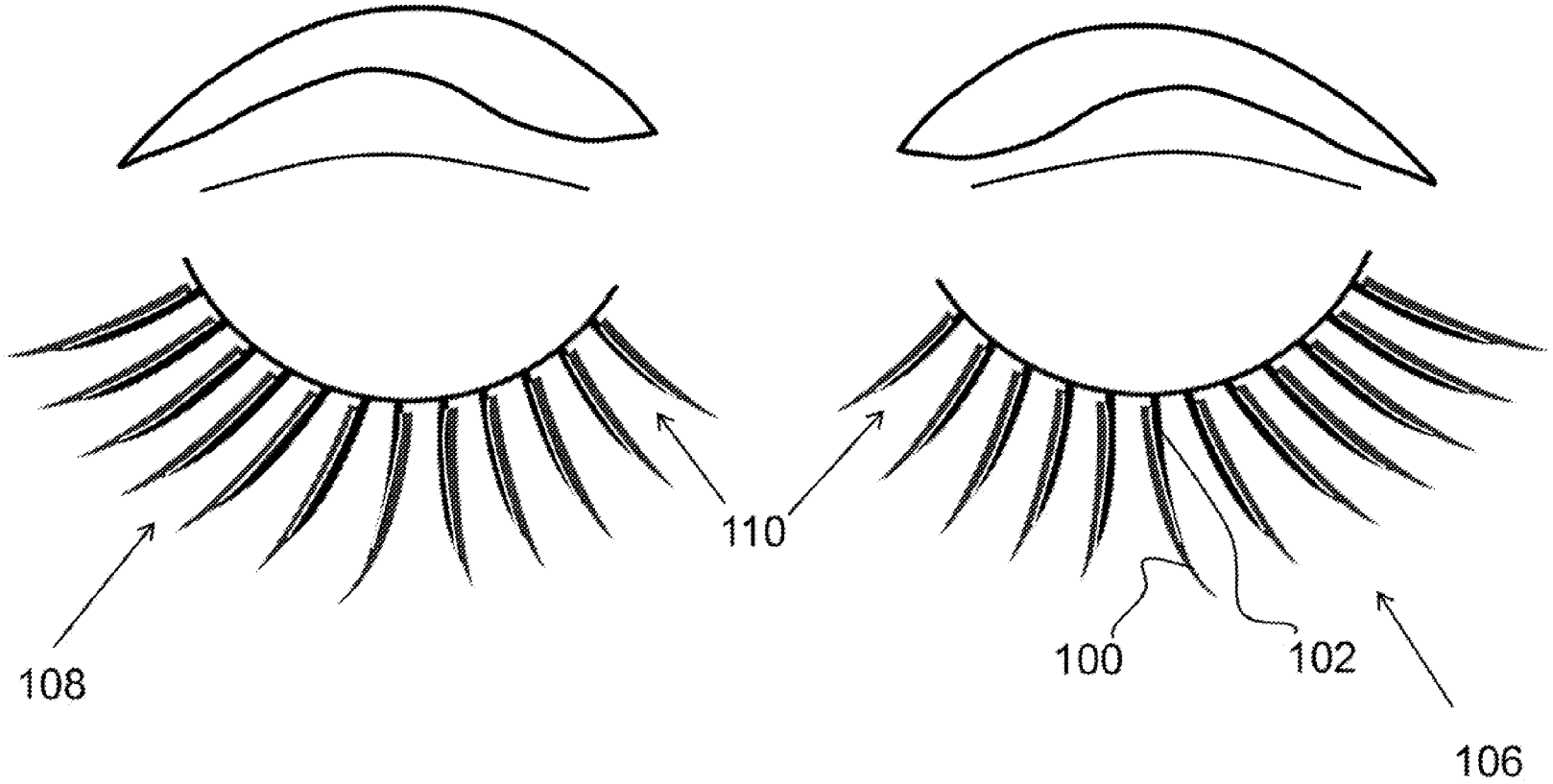
FIG. 1 is an illustration of a user's eyes closed, depicting eyelash extensions attached with eyelashes according to the method of the present invention.

The present invention relates to eyelashes and, more particularly, to a method for grouping eyelashes and applying eyelash extensions based on the eyelash groupings. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is, to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in, the claims herein is not intended to invoke the provisions of 35 U.S.C. 112, Paragraph 6.

If used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. It should be noted that the term "user" is often used in relation to the person whose eyelashes are being used and depicted and does not necessarily refer to the user of the present invention. The user of the present invention is any person who performs the acts described and depicted herein, such as an eyelash extension clinician who is applying the eyelash extension to the "user's" eyes.

(1) Description

The present invention relates to eyelashes and, more particularly, to a method for grouping eyelashes and applying eyelash extensions based on the eyelash groupings. For example, FIG. 1 is an illustration of user's eyes with eyelash extensions 100 attached according to the method of the present invention. As shown, eyelash extensions 100 are adhered to actual natural eyelashes 102 that are each separated from an eyelash group. The process described herein can be applied to the eyelashes corresponding to each of the user's first eye 106 and second eye 108. Also, while the invention is described and illustrated as being applied to the user's top eyelashes 110, it is not limited thereto as it can also be applied to the bottom eyelashes.

Figure 2:
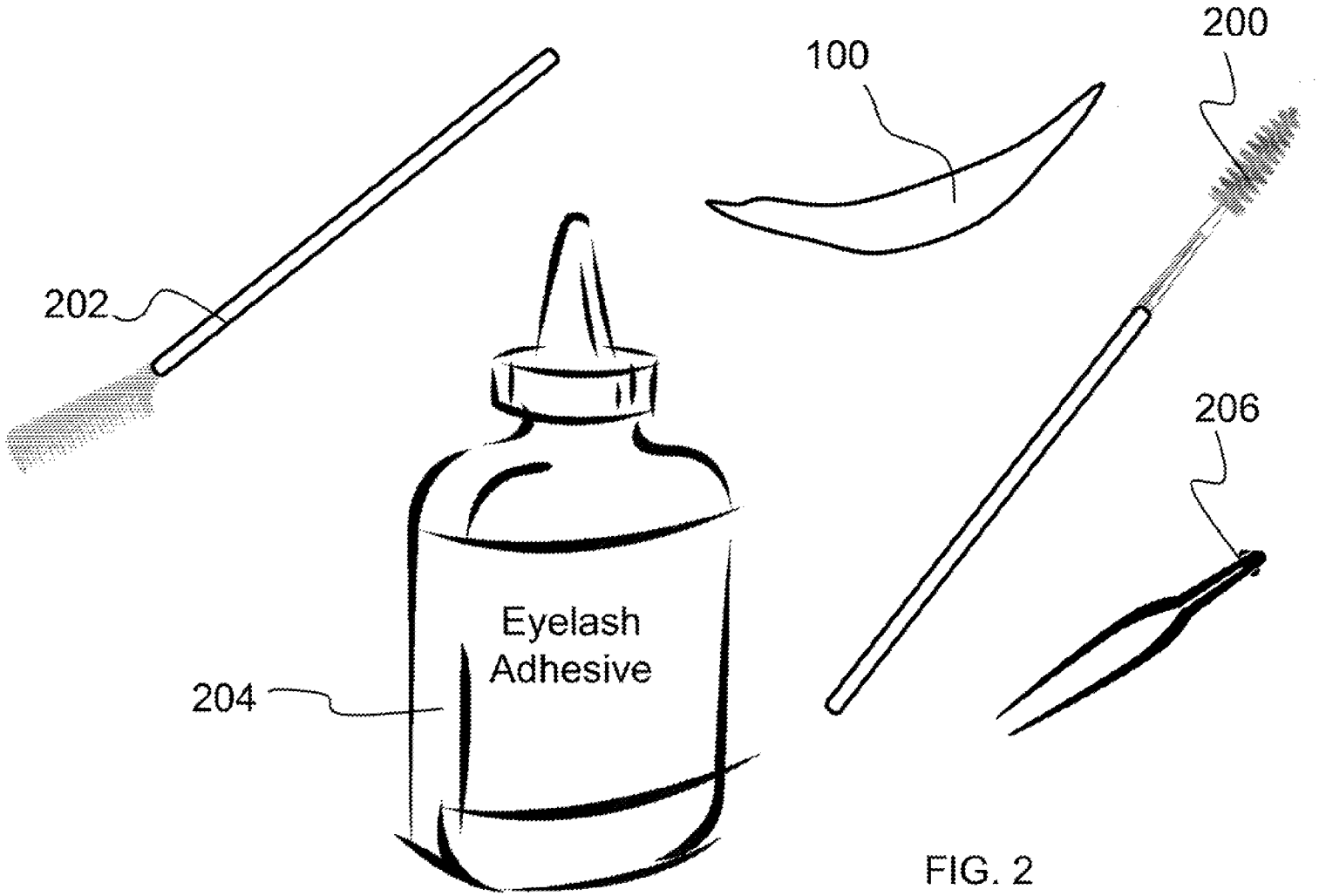
FIG. 2 is an illustration depicting various components that can be utilized in performing the method according to the present invention.

As shown in FIG. 2, the method according to the present invention can be performed using an eyelash extension 100 (or several eyelash extensions 100), an eyelash brush 200, an eyelash comb 202 (to optionally comb the eyelashes), and an eyelash adhesive 204. Tweezers 206 or a similar item may also be used, as described in further detail below.

Figure 3:
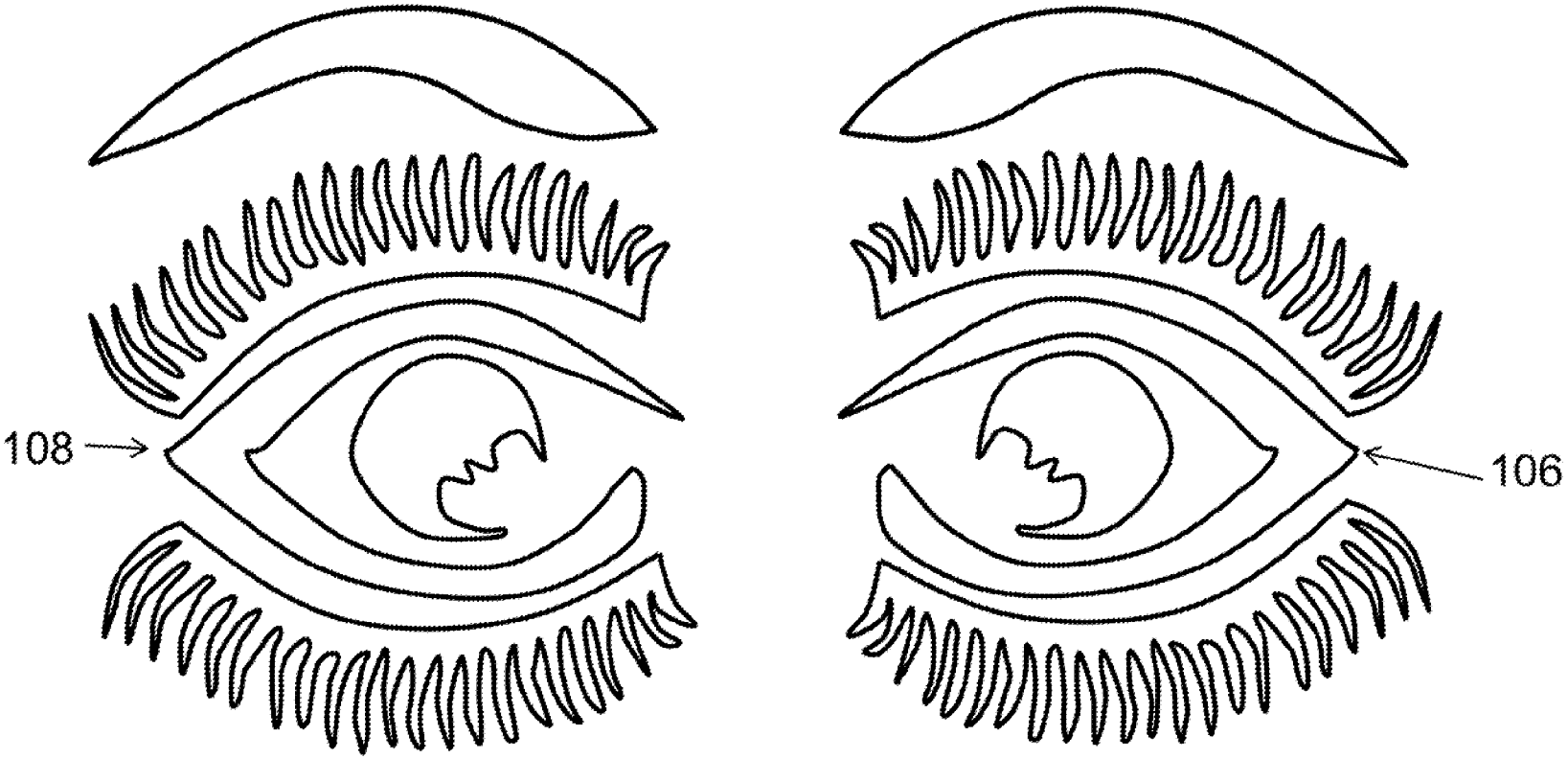
FIG. 3 is an illustration depicting a user's eyelashes.
Figure 4:
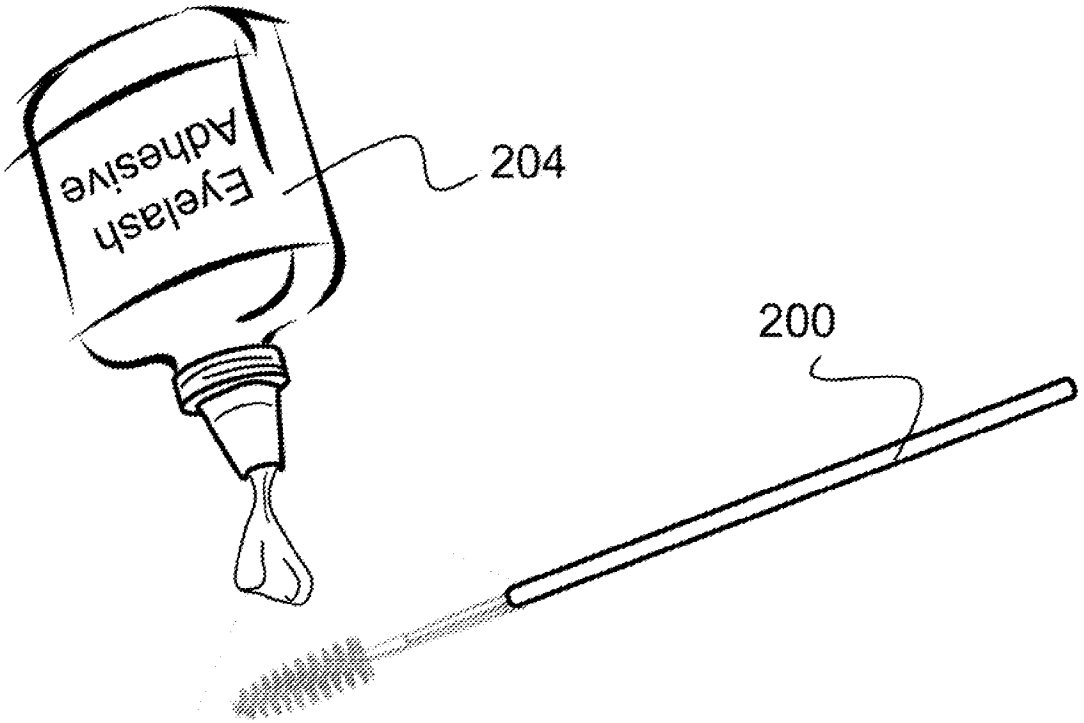
FIG. 4 is an illustration depicting eyelash adhesive being applied to a brush.
Figure 5:
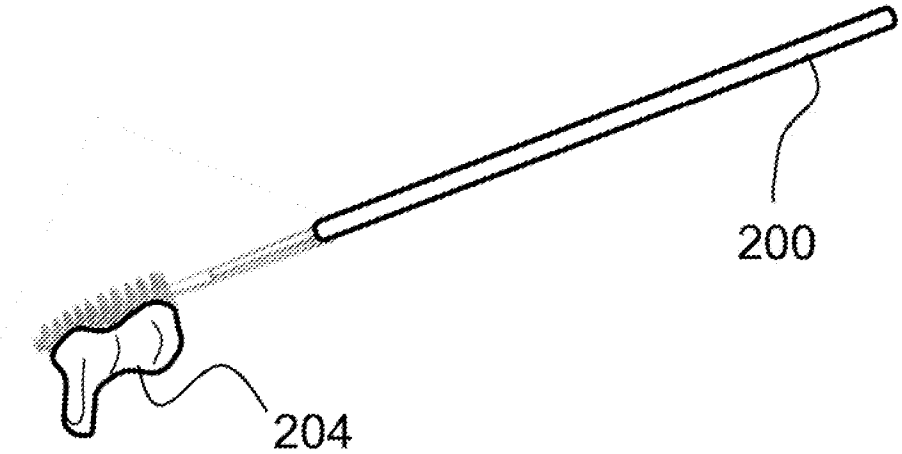
FIG. 5 is an illustration depicting the eyelash adhesive as applied to the brush.

FIG. 3 illustrates a user's first 106 and second eye 108 before beginning the method according to the present invention. To begin the process and as shown in FIGS. 4 and 5, an eyelash adhesive 204 is applied to an eyelash brush 200. The eyelash adhesive 204 is any suitable material that is capable adhering eyelashes together, non-limiting examples of which include glue, paint, gum, tape, or any other liquid or material.

It should be noted that although the use of an eyelash brush 200 is desirable, it is not required as the eyelash adhesive 204 can be applied to the user's eyelashes using any suitable mechanism, device or technique, non-limiting examples of which include being directly applied, sprayed on, taped, combed, etc.

Before applying any adhesive, the eyelashes can be prepared for application of the adhesive. Optionally, the user's eyelashes are cleaned using water or a cleaning solution. The eyelashes are then air-dried or dried using a fan or other drying mechanism.

Figure 6A:
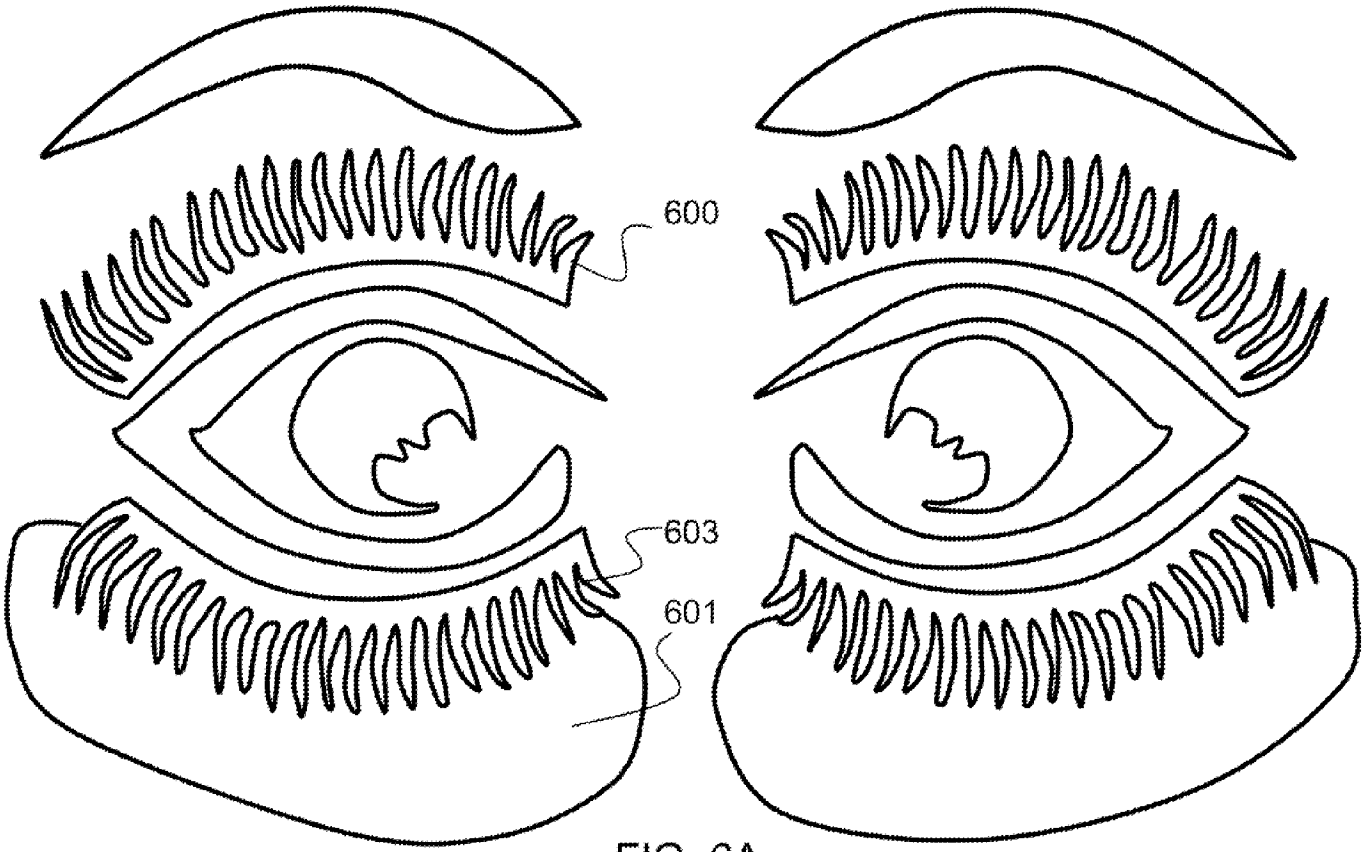
FIG. 6A is an illustration depicting patch being applied to a user.

As shown in FIG. 6A, after drying the user's actual eyelashes 600, a patch 601 is affixed to the user below the lower eyelashes 603. The patch 601 is any mechanism or device for creating a barrier upon the surface of the user's skin, non-limiting examples of which include a gel patch and tape.

Figure 6B:
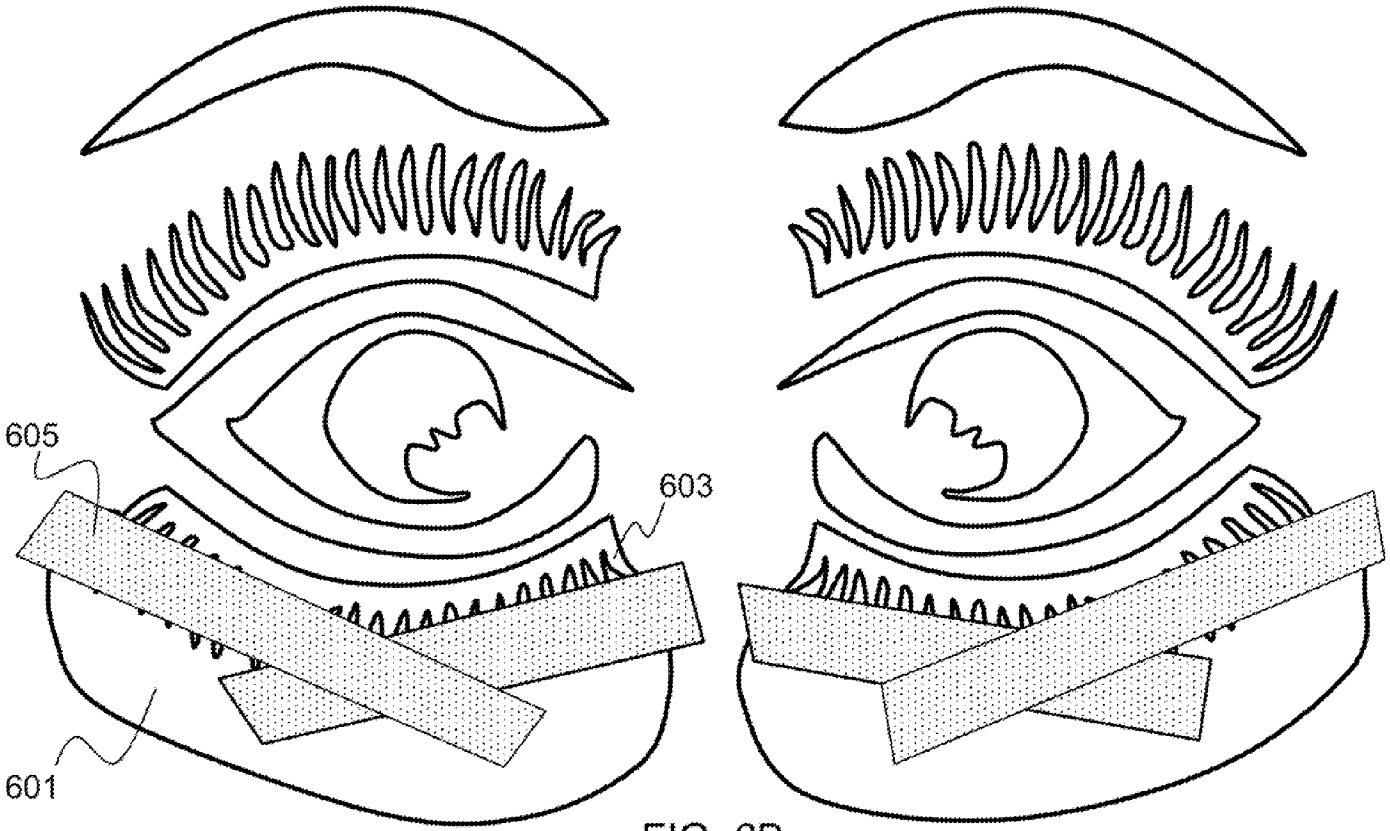
FIG. 6B is an illustration depicting a user's bottom eyelashes being affixed to the patch.

As shown in FIG. 6B, the lower eyelashes 603 are then fastened to the patch 601 using a fastener 605. It should be noted that the user's eyes are typically open at this point. However, this act can also be performed while the eyes are closed, or with one eye closed while the other is open. The fastener 605 is any mechanism or device for fastening one object against another, a non-limiting example of which includes tape.

Figure 6C:
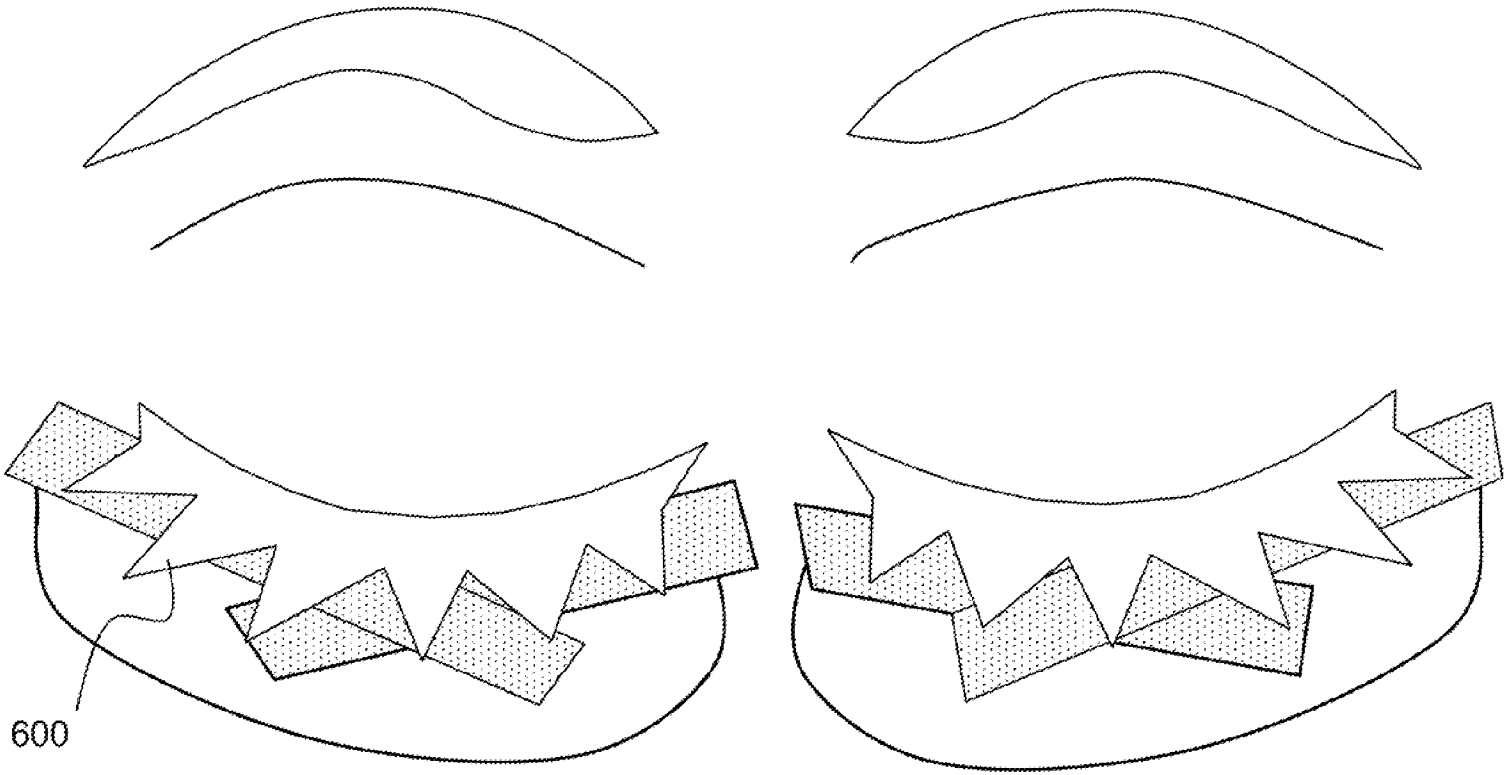
FIG. 6C is an illustration depicting a user as closing their eyes to allow for easy access to the user's top eyelashes.

As shown in FIG. 6C, a user can then close their eyes to allow a clinician easy access to the upper eyelashes 600. Additionally, when separating the eyelashes (as described below), tools used to separate the eyelashes do not touch the user's skin (increasing comfort).

While the process illustrated in FIGS. 6A through 6C is desirable, it is not required. Further it should be noted that although the present invention can be applied to one or both of the eyes. For convenience purposes and although the present invention is not limited thereto, FIGS. 6D through 16 depict the upper eyelashes of a single eye.

Figure 6D:
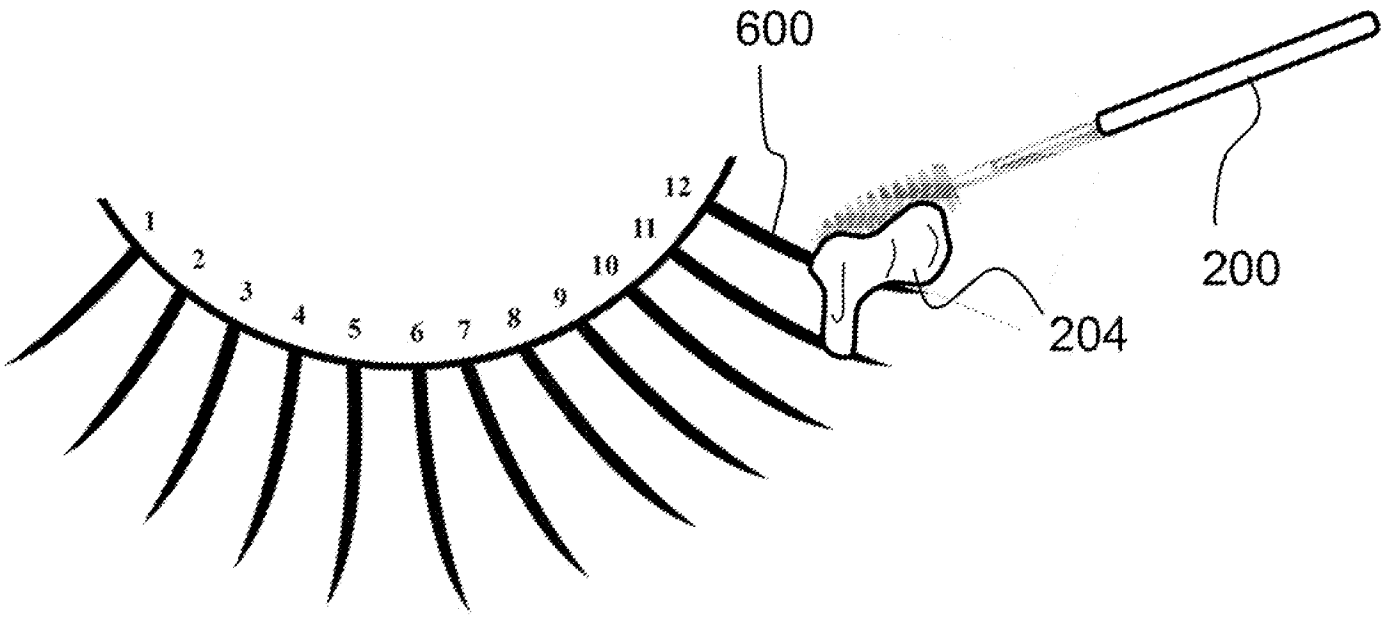
FIG. 6D is an illustration depicting the eyelash adhesive being applied to the user's eyelashes.

As noted above and as depicted in FIG. 6D, it is desirable to use an eyelash brush 200 to apply the eyelash adhesive 200 to the user's actual eyelashes 600. Thus, the eyelash brush 200 can be used to brush the eyelash adhesive 204 into a section of the user's eyelashes 600 to form an eyelash group or groups (depicted as element 104 in FIG. 7). It should also be noted that the user's eyes are desirably closed (as shown in FIG. 6D) while this procedure is performed.

Figure 7:
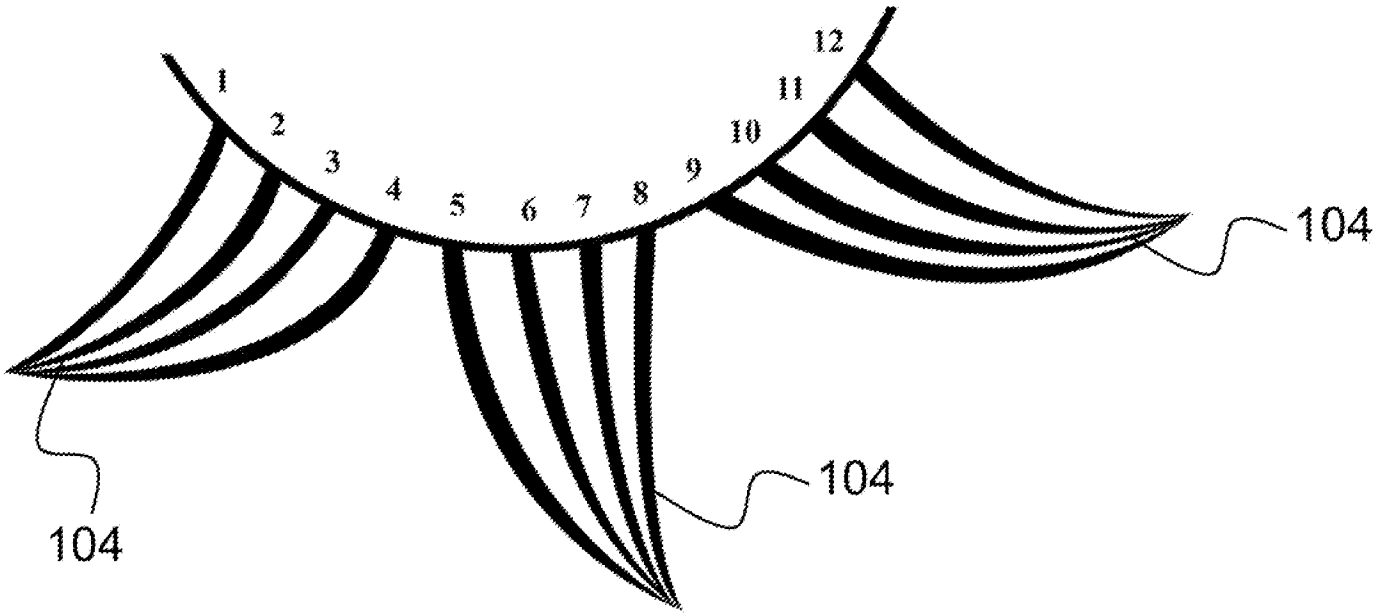
FIG. 7 is an illustration depicting the eyelashes grouped together through use of the eyelash adhesive to form several eyelash groups.

As shown in FIG. 7, the eyelash groups 104 are a grouping of actual eyelashes that are adhered together into a bunch or group. The eyelash groups 104 are any grouping of eyelashes that includes more than one eyelash, non-limiting examples of which include 2 eyelashes, 3 eyelashes, 5 eyelashes, etc. Further, there can be any number of eyelash groups 104 on either eye. Although FIG. 7 depicts 4 eyelash groups 104, the present invention is not intended to be limited thereto as there can be any number of eyelash groups 104. The process of grouping the eyelashes to form eyelash groups 104 can be continued for the remaining (ungrouped) eyelashes, including on one or both of the first and second eyes.

It should be noted that although it is desirable to use an adhesive to form the eyelash groups 104 (as described above), the present invention is not limited thereto as the groups can be formed simply by brushing or combing the eyelashes without the use of an adhesive. In this aspect, the eyelashes naturally stick together to some degree to form the individual eyelash groups 104. Alternatively and as described herein, an eyelash adhesive can be used to form the eyelash groups 104.

Figure 8:
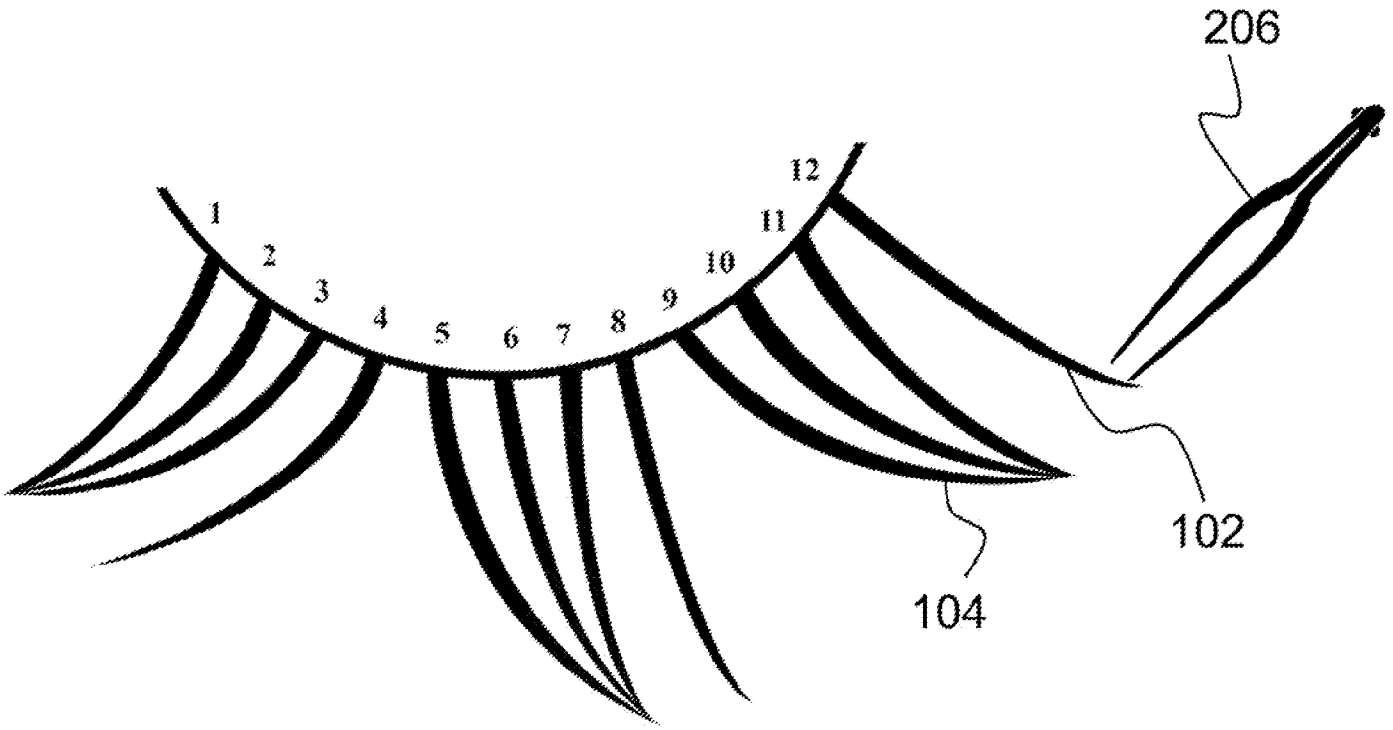
FIG. 8 is an illustration depicting an eyelash being pulled from each of the eyelash groups.

As show in FIG. 8, after at least one eyelash group 104 has been formed, an eyelash 102 is separated from the eyelash group 104. The eyelash 102 is separated (pulled or removed) from the eyelash group 104 using tweezers 206 or any other suitable mechanism, technique, or device. It should be noted that although multiple eyelashes can be pulled from the eyelash group 104 according to the present invention, desirably a single eyelash 102 is pulled from one of or each of the eyelash groups 104.

Figure 9:
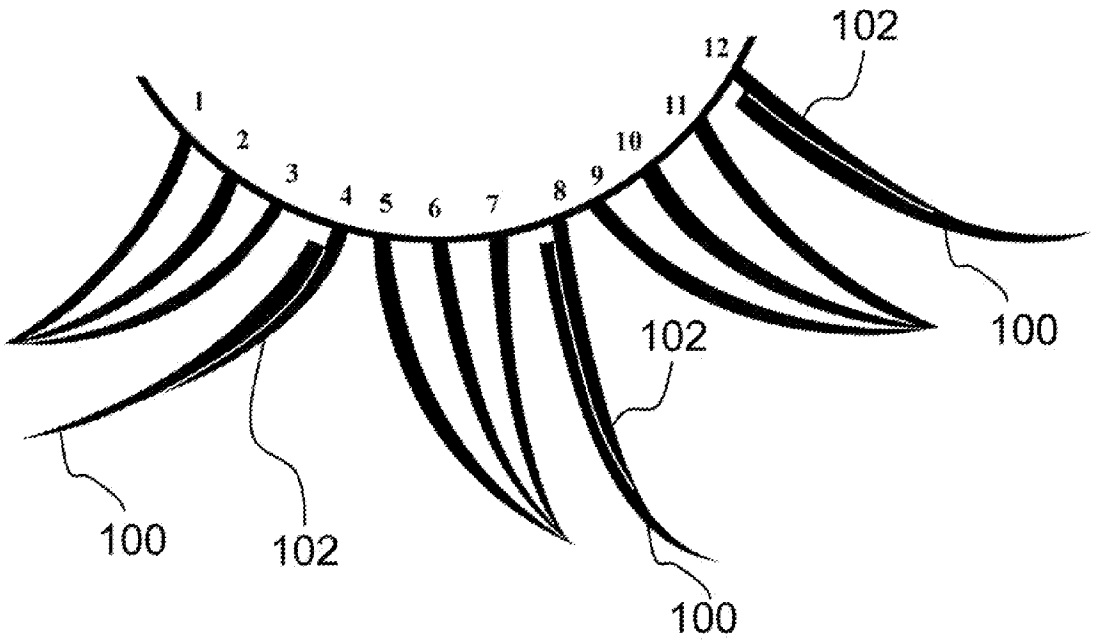
FIG. 9 is an illustration depicting eyelash extensions being applied to the eyelashes that were pulled from the eyelash groups.

Thereafter and as shown in FIG. 9, an, eyelash extension 100 is adhered to each eyelash 102 that is separated from an eyelash group 104. As can be appreciated by one skilled in the art, the eyelash extension 100 is adhered to the eyelash 102 using any suitable technique, such as using an eyelash glue to glue the eyelash extension 100 to the eyelash 102. It should be understood that although the eyelash extension 100 is depicted as a single eyelash extension 100 being attached to a single natural eyelash 102, the present invention is not intended to be limited thereto as multiple or branched eyelash extensions can be attached to the eyelash 102.

Figure 10:
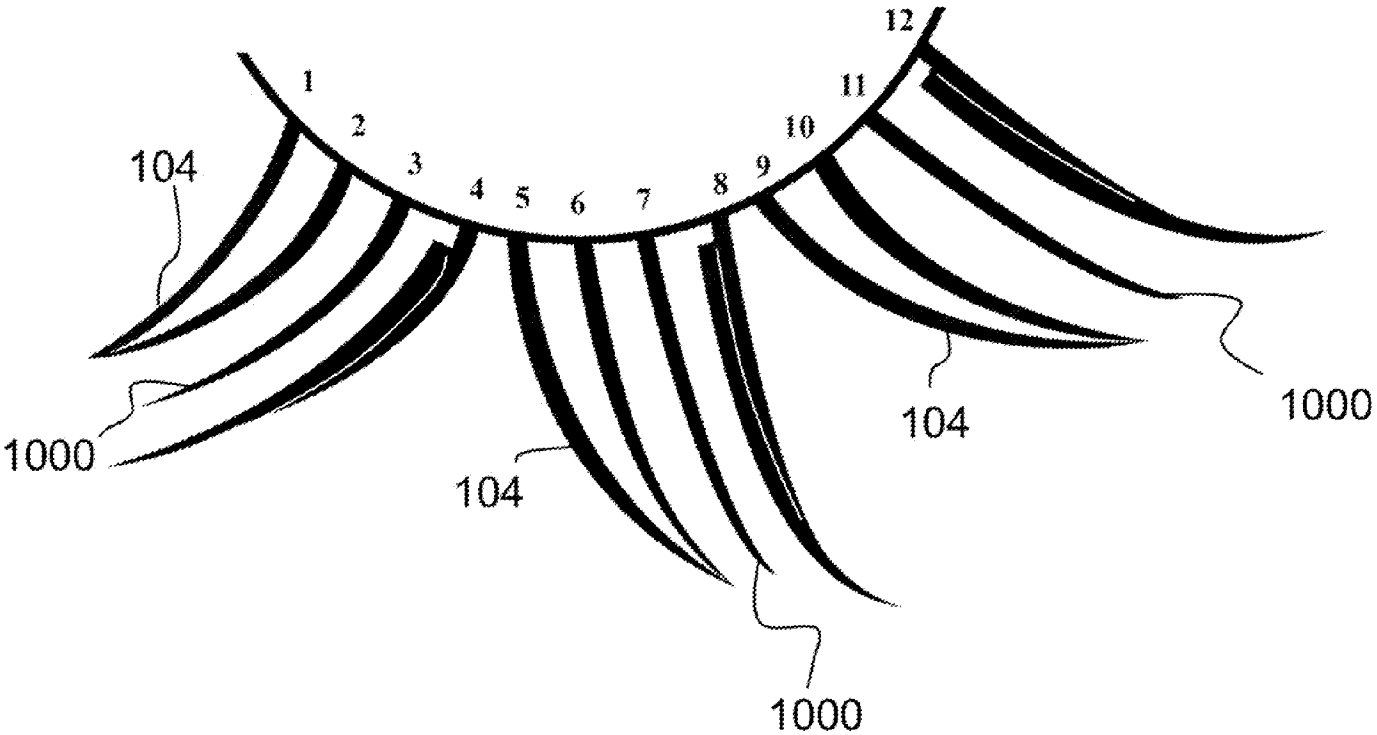
FIG. 10 is an illustration depicting a second eyelash being pulled from each of the eyelash groups.
Figure 11:
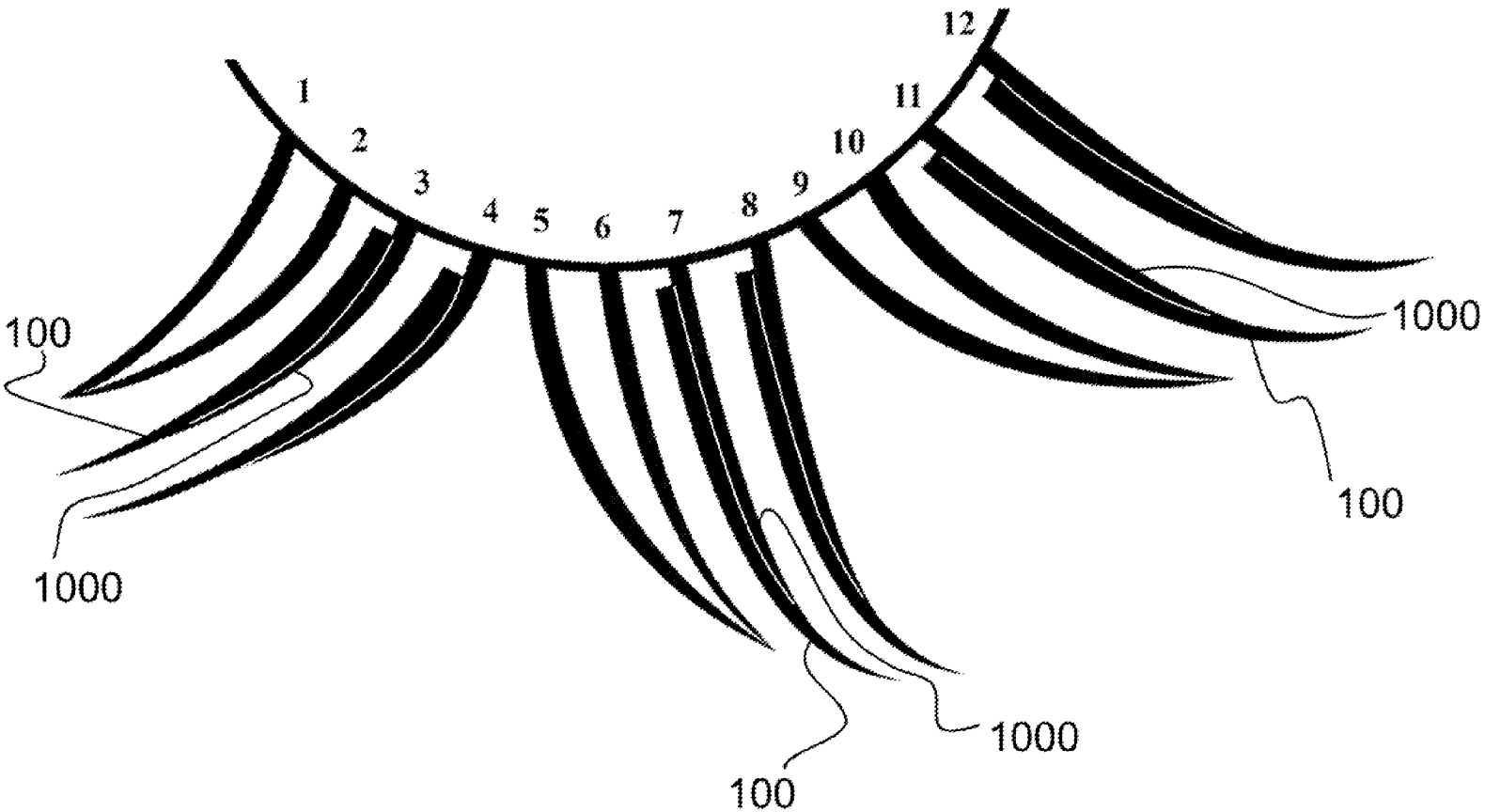
FIG. 11 is an illustration depicting eyelash extensions being applied to the second eyelashes that were pulled from the eyelash groups.

Next and as shown in FIG. 10, a second eyelash 1000 is separated from each eyelash group 104. Thereafter and as shown in FIG. 11, an eyelash extension 100 is adhered to each of the removed eyelashes 1000. As can be appreciated, this process of removing an eyelash from an eyelash group and applying eyelash extensions can be repeated any number of times until all eyelashes have been separated from the eyelash group.

Figure 12:
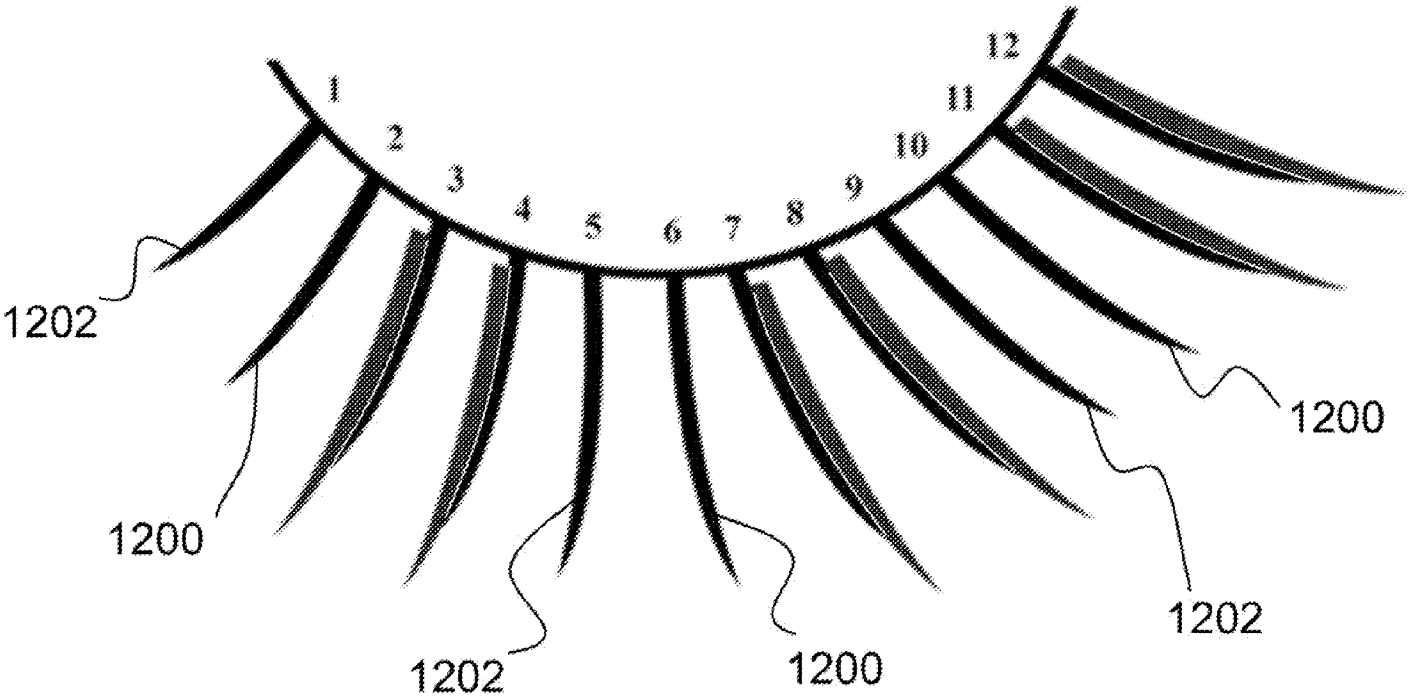
FIG. 12 is an illustration depicting a third eyelash being pulled from each of the eyelash groups.
Figure 13:
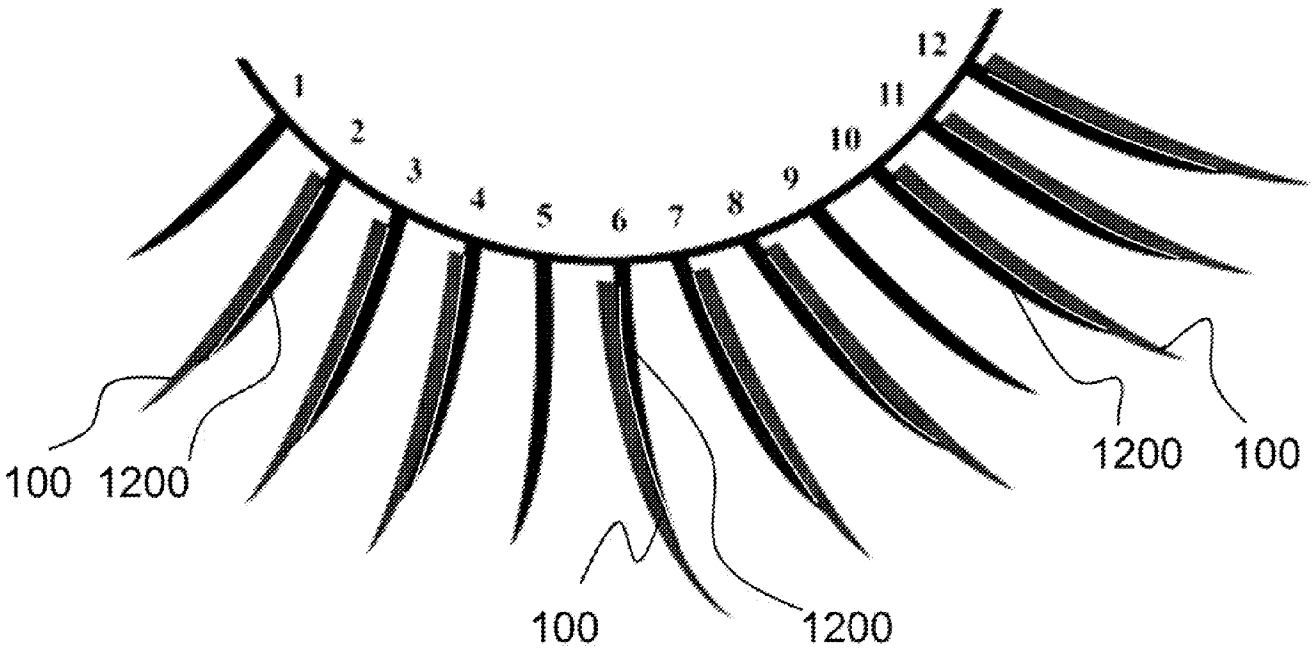
FIG. 13 is an illustration depicting eyelash extensions being applied to the third eyelashes that were pulled from the eyelash groups.
Figure 14:
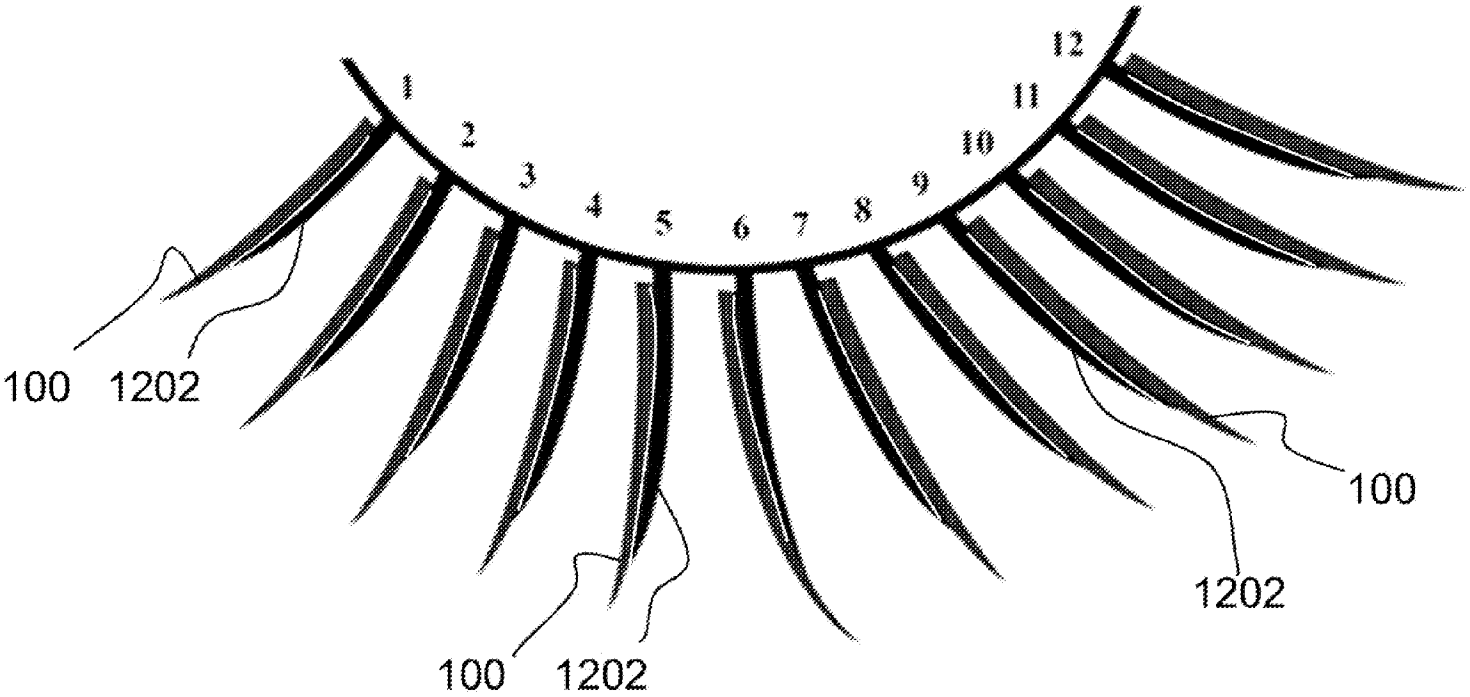
FIG. 14 is an illustration depicting eyelash extensions being applied to the last eyelash from each eyelash group.

For example and as shown in FIG. 12, a third eyelash 1200 is separated from each eyelash group, leaving only a last eyelash 1202 (from each eyelash group). Thereafter and as shown in FIGS. 13 and 14, an eyelash extension 100 is adhered to each of the removed eyelashes 1200 and last eyelash 1202.

It should be noted that although the process is described above as separating an eyelash from all eyelash groups and then applying eyelash extensions before proceeding on to the separating another eyelash from the eyelash group, the invention is not intended to be limited thereto. For example, the process could be performed such that the eyelashes are separated and applied to a single eyelash group before proceeding to another eyelash group.

Further, it should be noted that in separating the natural eyelash from an eyelash group, the natural lash can be separated from any group on any eye (e.g., first group or second group, or from the left or right eye). For example, the clinician or technician can start with the first eyelash group of the user's left eye first, or start at the third eyelash group on the right eye (or, at any other selected starting point) and then finish at any group on either eye. Thus, the present invention is not intended to be limited to a particular eye or eyelash group ordering.

In either event, the present invention provides a method for applying eyelash extensions through grouping and separating the user's natural eyelashes.

After wearing the eyelash extensions for a period of time, it is common for the adhesive to fail and for the eyelash extensions to fall off. As the eyelash extensions fall off, it is often desirable to perform a touch-up where additional eyelash extensions are applied. The touch-up process uses the method of the present invention where eyelash extensions are fastened to allow for the application of eyelash extensions to free eyelashes, thereby maintaining the beauty of the user.

For touch ups, refills or quick fixes, the method described above can be reemployed where the groups are formed of both natural lashes and eyelash extensions. Alternatively, for new sets of eyelashes, the natural eyelashes can be grouped according to the method herein.

What is claimed is:

1. A method for grouping eyelashes and applying eyelash extensions, comprising acts of:

forming an eyelash group by applying an eyelash adhesive solution to a plurality of actual eyelashes to adhere the eyelashes to one another to form the eyelash group, the eyelash group including a plurality of actual eyelashes that are adhered directly to one another such that they are not adhered to a user's upper eyelid;

separating an eyelash from the eyelash group; and adhering an eyelash extension to the eyelash that is separated from the eyelash group, thereby providing the user with an eyelash group and an eyelash extension applied to an actual eyelash.

2. The method of claim 1, further comprising acts of:

forming a second eyelash group;

separating a second eyelash from the second eyelash group; and adhering a second eyelash extension to the second eyelash.

3. The method of claim 2, further comprising an act of fastening a user's bottom eyelashes against the user's face prior to the act of forming an eyelash group.

4. The method of claim, further comprising an act of fastening a user's bottom eyelashes against the user's face prior to the act of forming an eyelash group.

5. A method for grouping eyelashes and applying eyelash extensions, comprising acts of:

forming a plurality of eyelash groups, each eyelash group including a plurality of actual eyelashes that are adhered directly to one another with an eyelash adhesive solution to form the eyelash group such that they are not adhered to a user's upper eyelid;

separating an eyelash from each of the eyelash groups; and adhering an eyelash extension to each eyelash that is separated from an eyelash group, thereby providing the user with an eyelash group and an eyelash extension applied to an actual eyelash.

* * * * *